US005511786A

United States Patent [19]

Antonious

[11] Patent Number: 5,511,786

[45] Date of Patent: Apr. 30, 1996

[54] WOOD TYPE AERODYNAMIC GOLF CLUB HEAD HAVING AN AIR FOIL MEMBER ON THE UPPER SURFACE

[76] Inventor: Anthony J. Antonious, 7738 Calle Facil, Sarasota, Fla. 34238

[21] Appl. No.: 308,422

[22] Filed: Sep. 19, 1994

[51] Int. Cl.[6] ..... A63B 53/04

[52] U.S. Cl. ..... 473/327

[58] Field of Search ..... 273/167 E, 164.1, 273/193 R, 194 R, 194 A, 187.4, 186.2, 162 R, 167 R, 77 R; D21/214–220

[56] References Cited

U.S. PATENT DOCUMENTS

| | | | |
|---|---|---|---|
| 3,829,102 | 8/1974 | Harrison | 273/186.2 |
| 3,997,170 | 12/1976 | Goldberg | 273/167 E |
| 4,077,633 | 3/1978 | Studen | 273/164.1 |
| 5,004,241 | 4/1991 | Antonious | 273/167 E |
| 5,092,599 | 3/1992 | Okumoto | 273/167 E |
| 5,193,810 | 3/1993 | Antonious | 273/164.1 |
| 5,221,086 | 6/1993 | Antonious | 273/167 E |
| 5,318,297 | 6/1994 | Davis | 273/167 E |

*Primary Examiner*—Sebastiano Passaniti
*Attorney, Agent, or Firm*—Aquilino & Welsh

[57] ABSTRACT

A wood type golf club head having an aerodynamic upper surface, creating an air flow pattern to reduce drag on the club head, including a raised aerodynamic airfoil member extending upwardly from the top surface in a heel to toe direction.

11 Claims, 12 Drawing Sheets

WOOD TYPE AERODYNAMIC GOLF CLUB HEAD HAVING AN AIR FOIL MEMBER ON THE UPPER SURFACE

BACKGROUND AND DESCRIPTION OF THE INVENTION

The present invention relates to golf club heads, and more particularly, to wood type golf club heads having an aerodynamic upper surface to reduce drag and increase club head speed and stability as it is swung during the execution of a golf swing.

Wood type golf clubs are used for hitting a golf ball a longer distance, such as drivers, which are generally used for the first shot of a given hole from a teed position to obtain maximum distance, and are also used from the fairway for subsequent shots that also require the ball to travel a long distance toward or onto the putting green. The distance a golf ball travels is determined by the club head speed at the moment of impact and the weight of the club head, in accordance with well known physical laws. Conventional golf clubs are provided with a generally flat, broad club face and an asymmetric overall shape. Such designs have been known extensively for a number of years. This typical wood type golf club head, although it has some aerodynamic characteristics, when swung creates a vacuum at the rear of the club had resulting in considerable aerodynamic drag, which reduces the speed of the club head for a given force executed by a golfer.

Various efforts have been made to increase club head speed by creating a controlled, favorable turbulence which reduces the area of the vacuum thereby reducing aerodynamic drag, as shown in my prior U.S. Pat. Nos. 3,468,544 and 4,828,265, among others. Another patent of interest is U.S. Pat. No. 2,550,846 to Milligan, which shows a golf club head having a shallow recess in the top surface and bottom of the club head. A patent to Gordos (U.S. Pat. No. 4,065,133) shows a golf club head having a plurality of spaced grooves which are deep, but which are relatively small and narrow compared to the overall size of the club head. A patent to Goldberg (U.S. Pat. No. 3,997,170) shows a club head having a plurality of parallel grooves which are also relatively shallow with respect to the overall club head size. A patent to Bock (U.S. Pat. No. Des. 240,748) shows a golf club head with an air foil rear surface. The patent to Sinclair (U.S. Pat. No. 4,900,029) relates to a golf club head having a vertical air foil and a cavity formed in the upper surface to achieve less drag as the club head is swung. The patent to Okumoto et al. (U.S. Pat. No. 5,092,599) shows a golf club having a stripe-like projection on its upper surface which extends across the full range of the transverse direction and in conformity with the planar shape of the face to create an aerodynamic effect to increase club head speed.

Still another golf club head is shown in the design patent to Henrich (U.S. Pat. No. Des. 192,515) having an aerodynamic upper surface with a pair of air foil members extending rearwardly from the ball striking face. A design patent to Newton (U.S. Pat. No. Des. 185,717) shows a wood type golf club head with a thin member on the upper surface thereof. Finally, the patent to Phillips (U.S. Pat. No. Des. 183,180) shows a golf club head, which appears to be a putter, having a triangularly-shaped upper surface.

SUMMARY OF THE INVENTION

The present invention relates to a golf club head having an improved aerodynamic upper surface in the form of at least one aerodynamic air foil member on the top surface and extending in a toe to heel direction approximately midway between the ball striking face and rear surface on the top surface. The air foil member creates a favorable turbulence to quickly achieve a laminar boundary layer condition in the air flow pattern across the top surface of the club head, causing the controlled high-velocity air to flow smoothly over the rear surface in a more directional controlled manner to reduce pressure at that point and, therefore, reduce drag. This permits a club head to be swung faster for a given application of force. In a preferred embodiment, a single generally rectangular air foil member extends between the toe and the heel on the top surface of the golf club head. Other embodiments include a plurality of parallel air foil members which may be formed in vertical or sloped configurations extending in a heel to toe direction. The invention also contemplates the use of at least one additional air flow channel formed in the top surface of the club head in combination with a heel to toe air foil member and the use of air foil members which are angularly disposed on the top surface of the club head.

DESCRIPTION OF PREFERRED EMBODIMENTS

The present invention relates to golf club heads, and more particularly, to wood type golf club heads having an improved aerodynamic upper surface.

Figure 1:
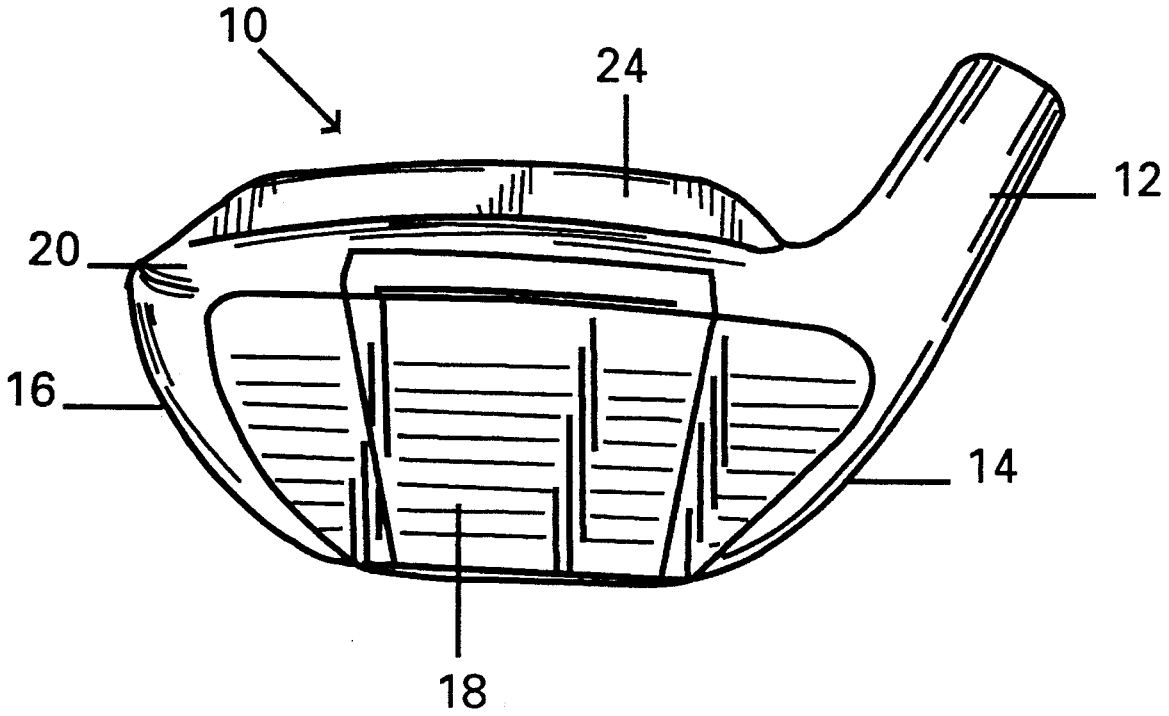
FIG. 1 is a front elevational view of a golf club head having an improved aerodynamic upper surface.
Figure 2:
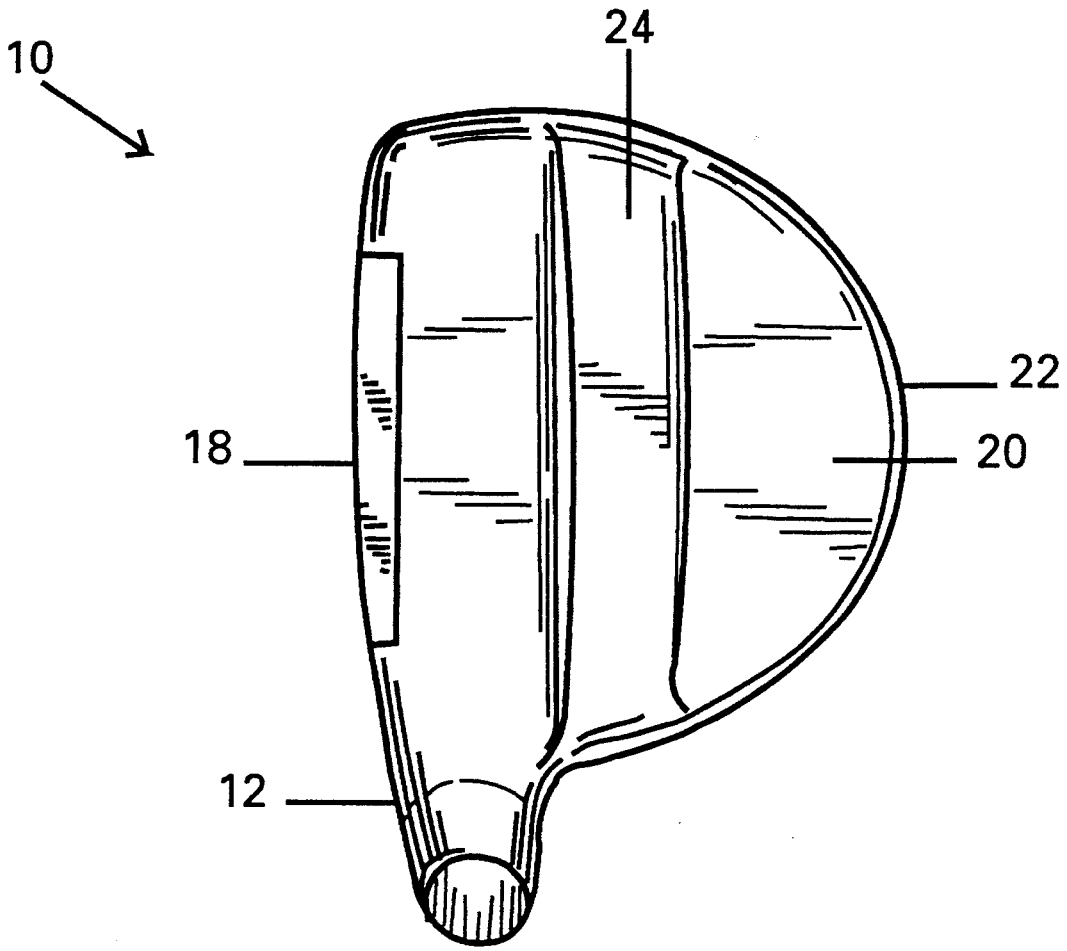
FIG. 2 is a plan view of FIG. 1.
Figure 3:
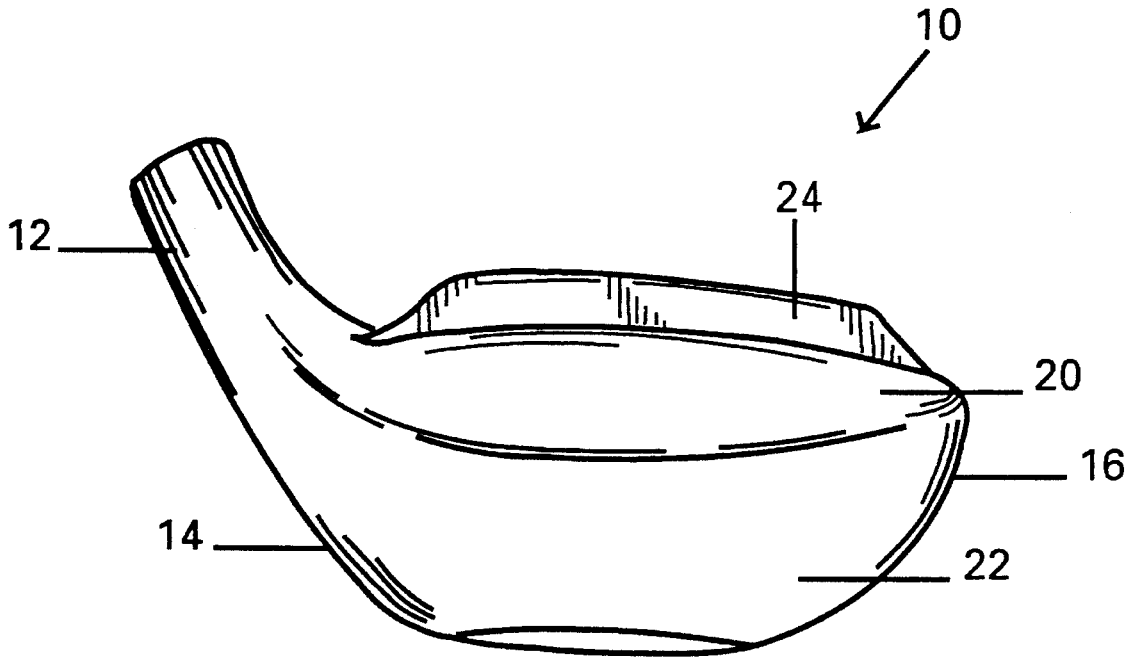
FIG. 3 is a rear elevational view thereof.

In the present invention, a club head 10 is provided with an aerodynamic upper surface formed of an air foil member extending in a heel to toe direction. Referring to FIGS. 1–3, the club head 10 includes a hosel 12, a heel 14, toe 16, ball striking face 18, top surface 20 and rear surface 22. An aerodynamic air foil member 24 is integrally formed with and extending above the top surface 20 of the club head 10. The air foil member 24 is preferably rectangular in shape, particularly when viewed in plan, as shown in FIG. 2, but which includes rounded and tapered edges to enhance the overall symmetry and aesthetic features of the club head. The longitudinal axis of the air foil member 24 extends in a heel 14 to toe 16 direction so the elongated portion of the member 24 is parallel to the ball striking face 18. The air foil member is positioned approximately midway between the ball striking face 18 and the rear surface 22 on the top surface 20 of the club head. It will be appreciated that air foil member 24 may be formed of an exact rectangular configuration, having well defined and sharp edges in keeping within the spirit and scope of the present invention.

In the present embodiment, the air foil member 24 would be at least one-eighth (⅛) inch high and have a width of from one-quarter (¼) to one (1) inch in a front-to-rear direction between the ball striking face and the rear surface. It will be appreciated that minor variations in the exact dimensions of the air foil member may be made in keeping with the present invention, however, it is contemplated that the air foil member be at least one-quarter (¼), or 25 percent of the overall length of the top surface of the golf club head in the front-to-rear direction.

When the golf club head of the present invention using the improved aerodynamic upper surface is swung by a golfer, the air flow spills over the ball striking face 18 and over the top surface 20 of the club head. Generally, the air flow is turbulent as it cascades over the crown surface, but as soon as it contacts the air foil member 24, a controlled laminar type air flow is established which directs this high velocity air flow over the top surface, past the rear surface of the club head, increasing the pressure behind the club head and thereby reducing drag. The reduction in drag enables a golf club head to be swung faster for a given force provided by the golfer in the execution of a golf swing. The faster the club head is swung,-the further the ball can be hit for a given effort.

It will be appreciated that the embodiments shown in FIGS. 4–9 all use golf club heads of the same general configuration as the embodiment shown in FIGS. 1–3. In each embodiment, the air foil configuration on the top surface of the club head is shown forming a distinct species of the present invention.

Figure 4:
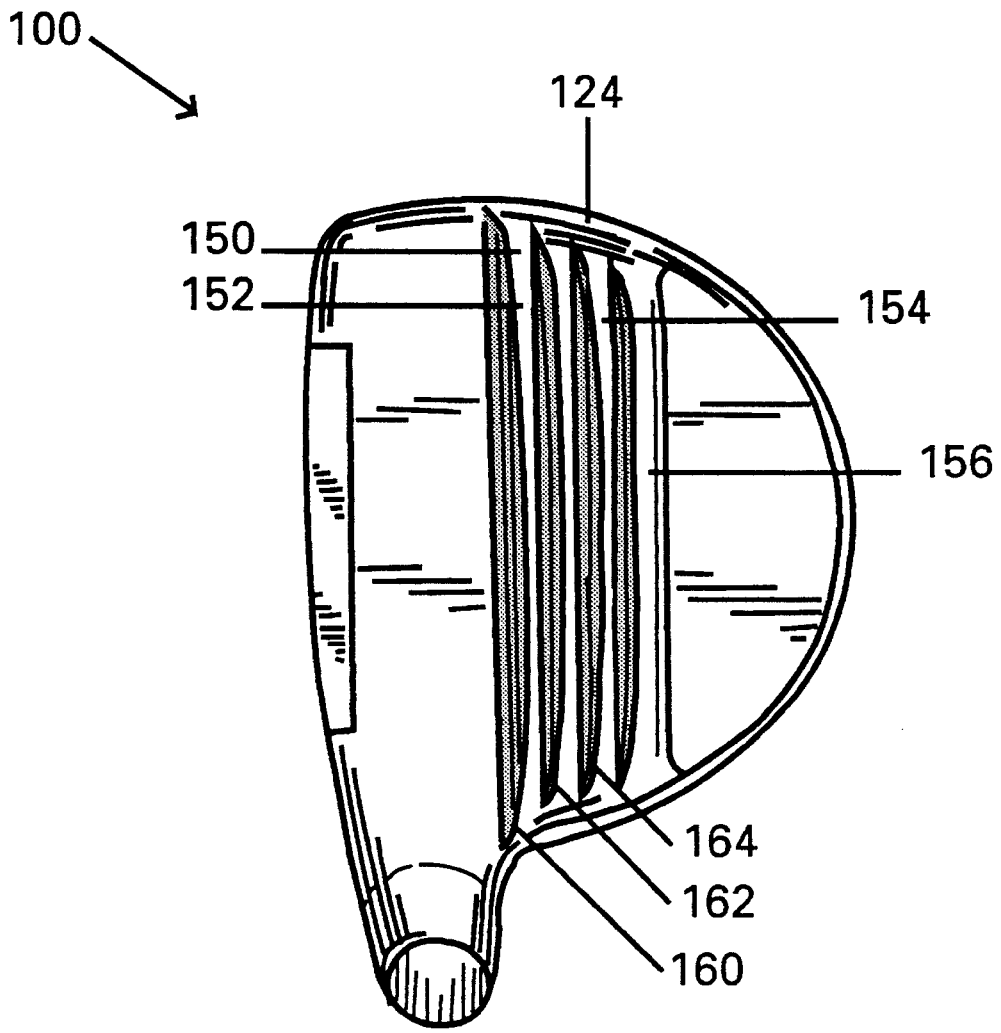
FIG. 4 is a top plan view of a second embodiment of the present invention.

FIG. 4 illustrates a second embodiment of a club head 100 of the present invention having an aerodynamic air foil member 124 formed by a series of parallel struts 150, 152, 154 and 156 formed on the air foil member 124 and further defined by a series of parallel spaces 160, 162 and 164 separating each of the strut members. The overall configuration of air foil member 124 lies in a heel-to-toe direction and has a width approximately ¼ to ⅓ of the distance on the top surface in the front to rear direction. Whereas the air foil member of this embodiment is shown with four strut members, it will be appreciated that more or less of the strut members may be provided in keeping within the scope of the invention.

Figure 5:
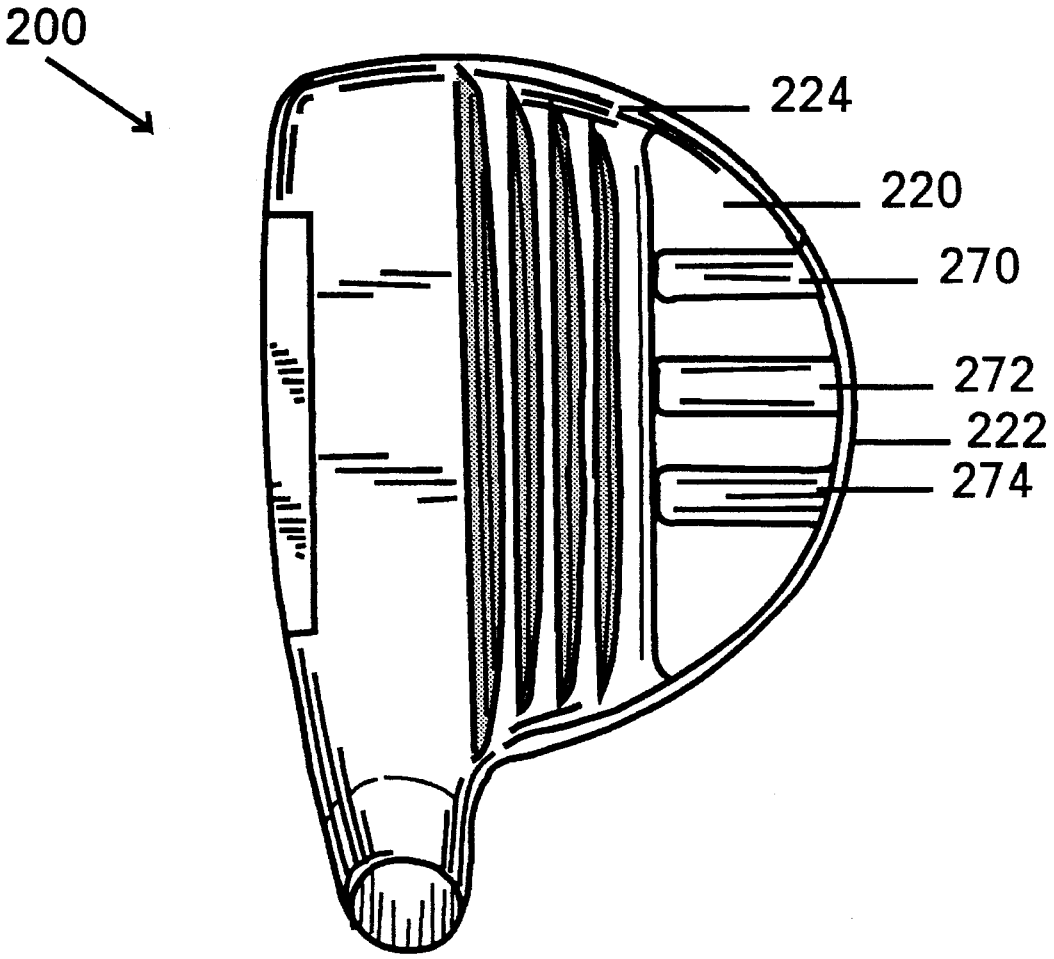
FIG. 5 is a top plan view of a third embodiment of the present invention.

FIG. 5 shows a third embodiment of a golf club head 200 of the present invention including an air foil member 224 formed at a series of struts of the same type as shown in FIG. 4.

In this embodiment, a plurality of slots 270, 272 and 274 are formed in the upper surface 220 and extend in a direction perpendicular to the air foil member 224 and between the member 224 and the rear surface 222 of the club head.

Figure 6:
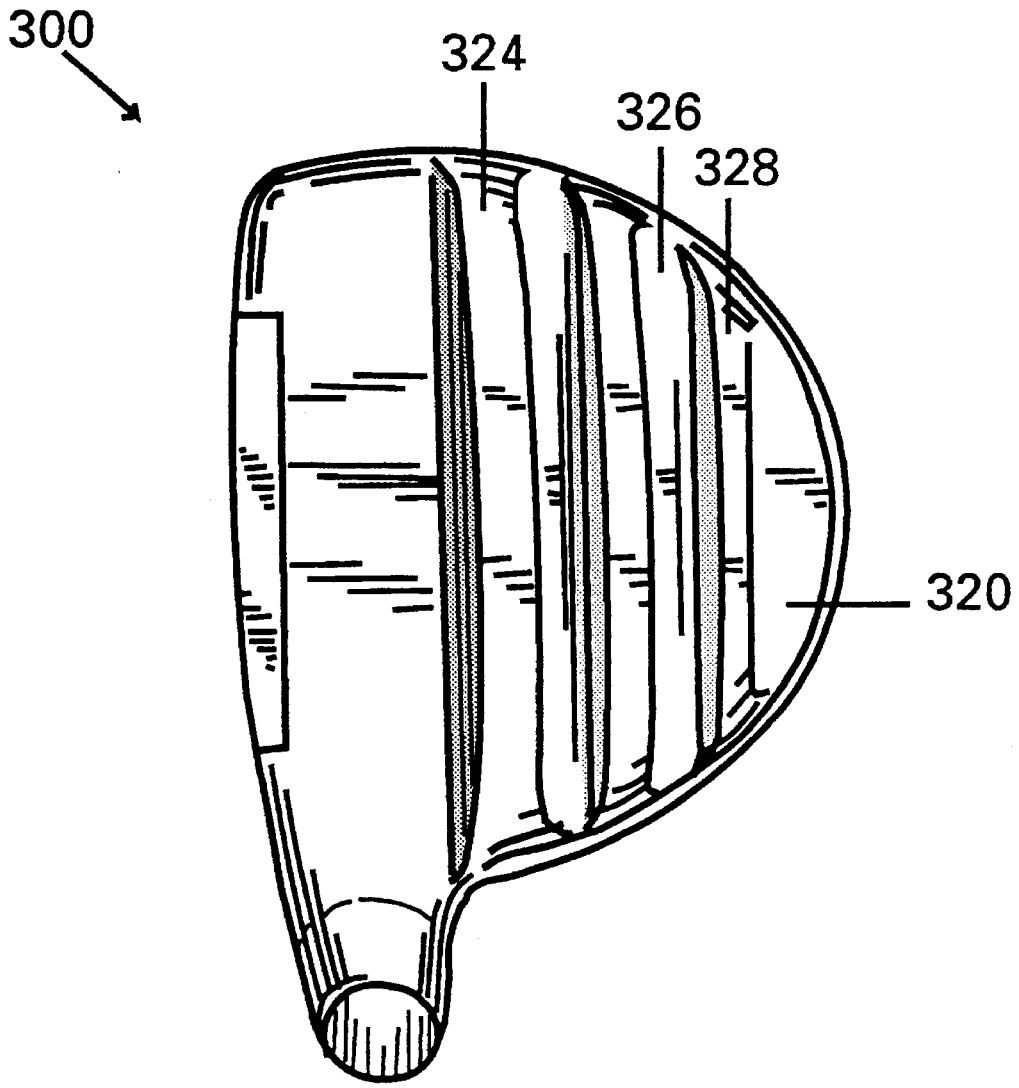
FIG. 6 is a top plan view of a fourth embodiment of the present invention.

FIG. 6 shows a fourth embodiment of a golf club head 300 of the present invention including a plurality of parallel spaced air foil members 324, 326 and 328, located on the top surface 320 of the club head 300. The overall width of the air foil members is approximately ½ of the distance on the top surface of the club head in the front to rear direction.

Figure 7:
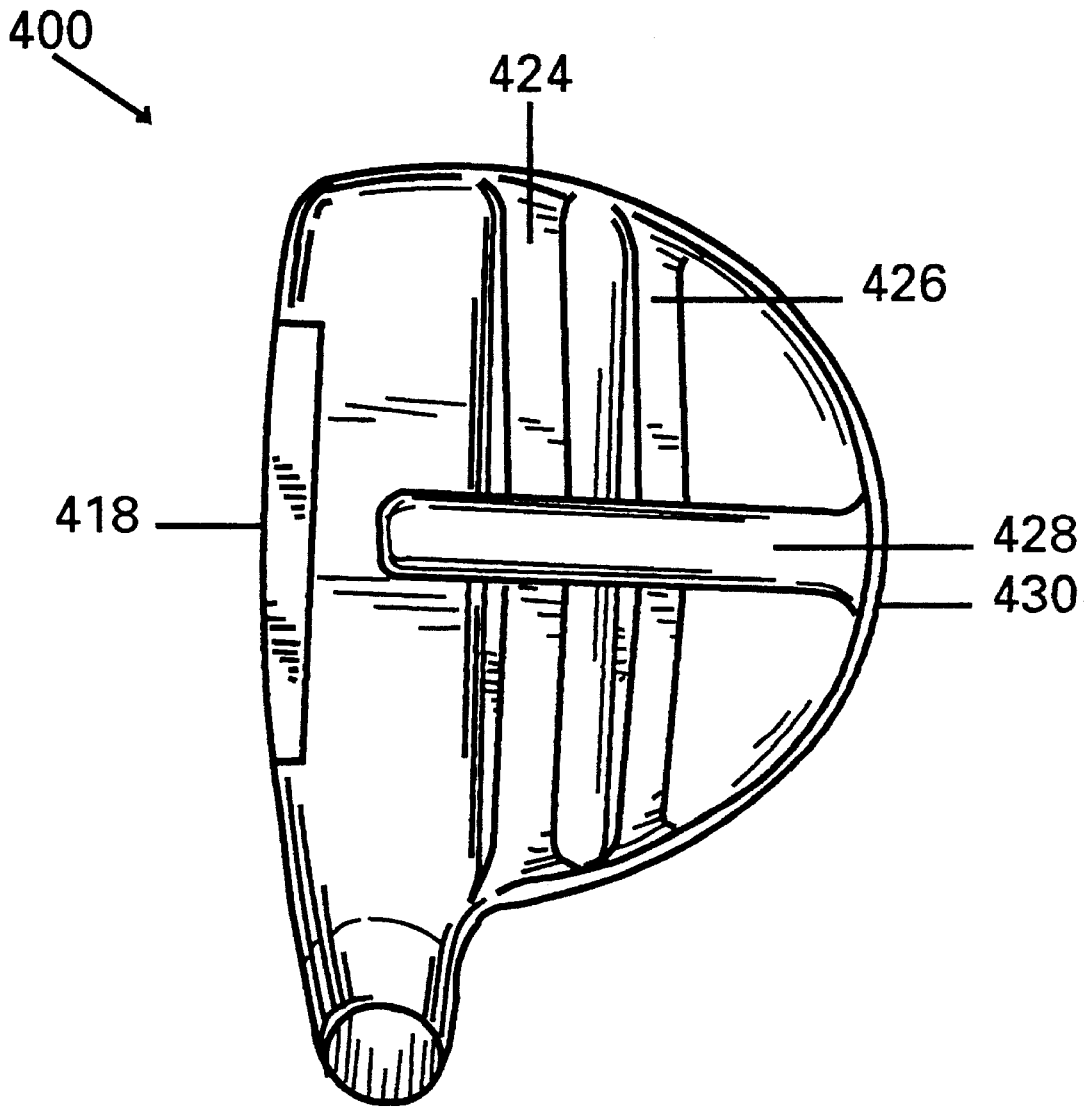
FIG. 7 is a top plan view of a fifth embodiment of the present invention.

FIG. 7 shows a fifth embodiment of a golf club head 400 of the present invention including a pair of air foil members 424 and 426 in combination with an air channel 428 perpendicular thereto. The channel groove extends from the rear edge 430 to a point behind the ball striking face 418 and bisects each air foil member approximate its midpoint.

Figure 8:
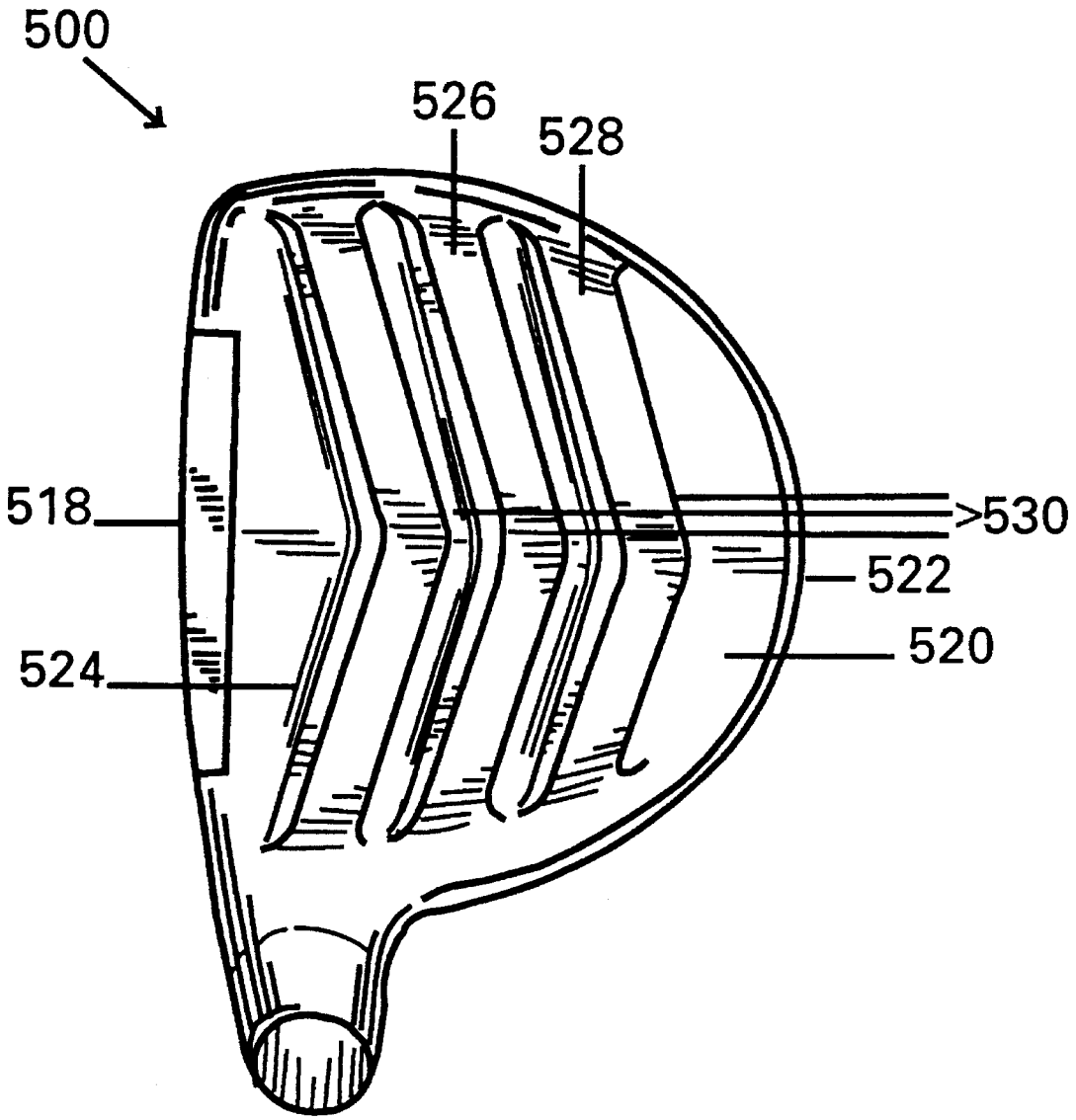
FIG. 8 is a top plan view of a sixth embodiment of the present invention.

FIG. 8 shows a sixth embodiment of a golf club head 500 of the present invention having a series of angular aerodynamic air foil members 524, 526 and 528 on the top surface 520 of the club head 500, each of the air foil members including an apex 530 pointing in a direction toward the rear surface 522 of the club head 500.

Figure 9:
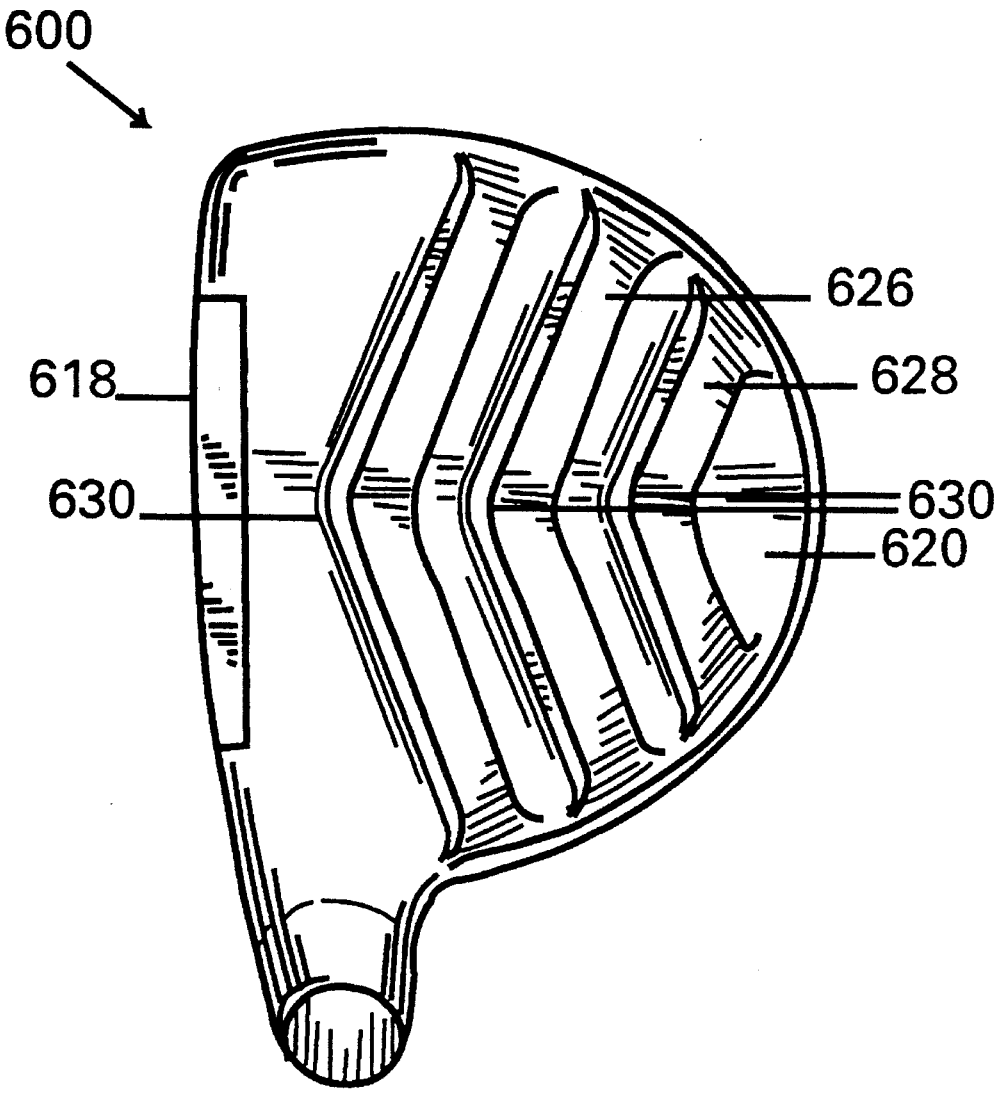
FIG. 9 is a top plan view of a seventh embodiment of the present invention.

FIG. 9 shows a seventh embodiment of a golf club head 600 the present invention having a series of angular aerodynamic air foil members 624, 626 and 628 on the top surface 620 of the club head 600, each of the air foil members including an apex 630 pointing in a direction toward the ball striking face 618 of the club head 600.

Figure 10:
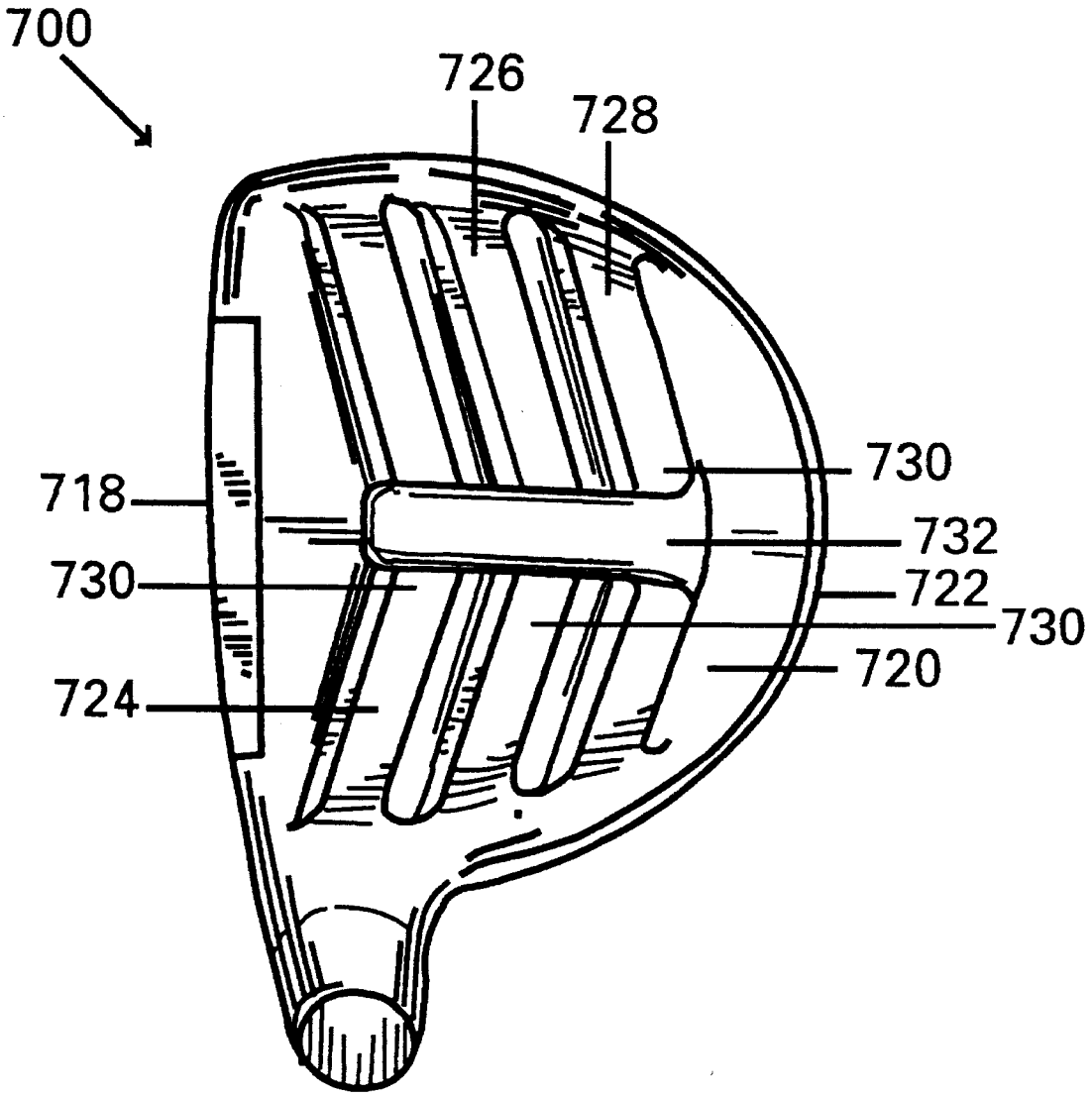
FIG. 10 is a top plan view of an eighth embodiment of the present invention.
Figure 11:
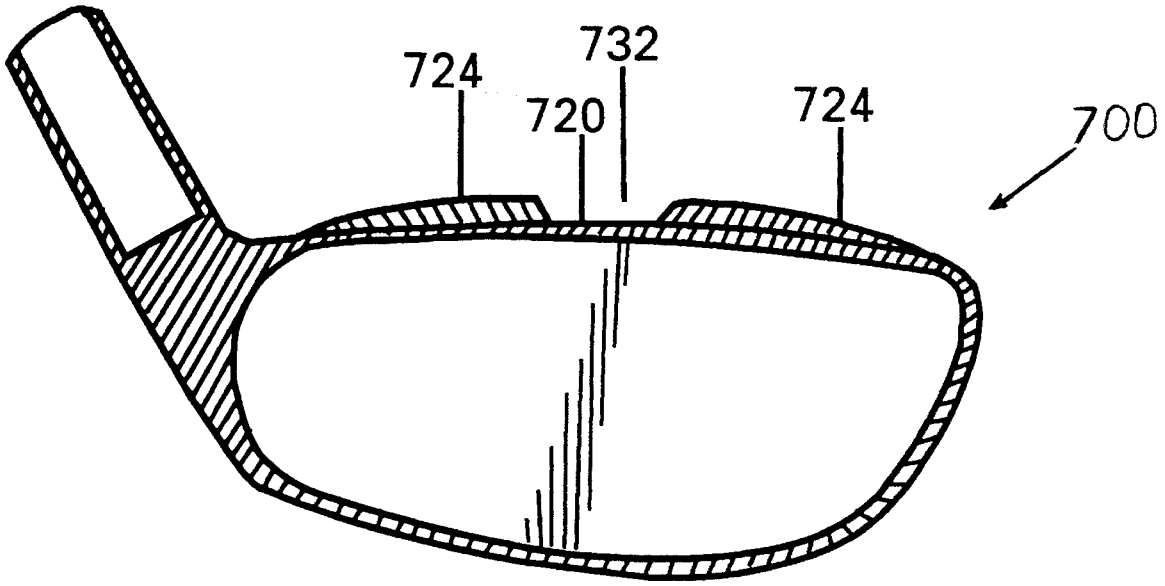
FIG. 11 is a sectional view taken along the line 11—11 of FIG. 10.

FIGS. 10 and 11 show an eighth embodiment of a golf club head 700, the present invention having a series of angular aerodynamic air foil members 724, 726 and 728 on the top surface 720 in combination with an air channel 732 perpendicular thereon. The air channel 732 extends from approximate the rear edge of air foil member 728 to a point approximate the frontal midpoint of air foil member 724. The bottom of the airfoil member 728 is coincident with the top surface 720 of the club head 700. Each of the air foil members including apexes 730, point in a direction toward the rear surface 722 of the club head 700.

Figure 12:
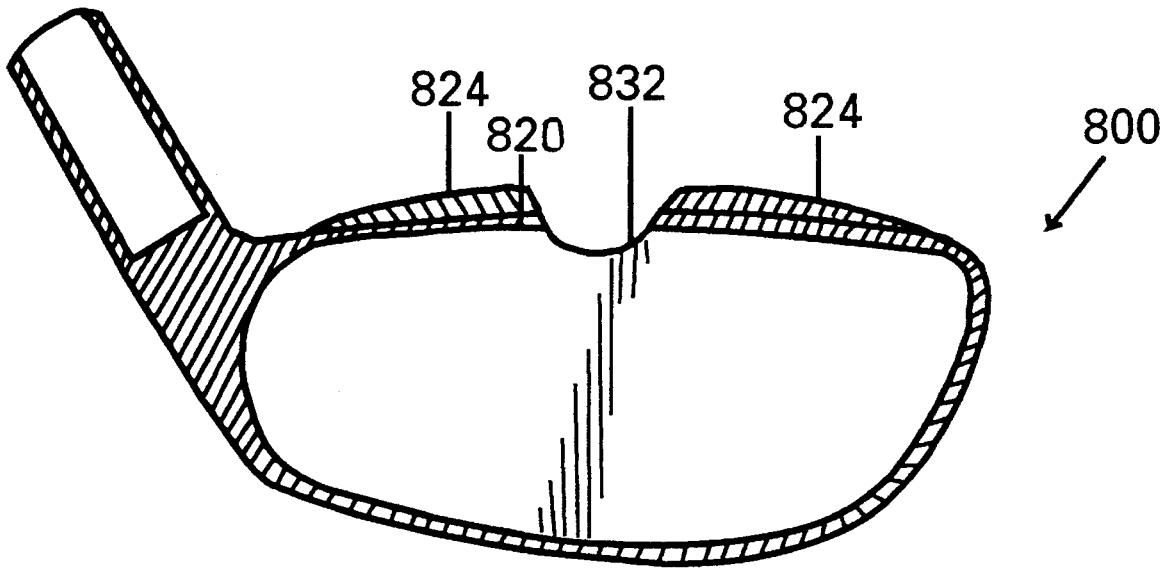
FIG. 12 is a sectional view of a ninth embodiment of the present invention.

FIG. 12 shows a ninth embodiment of a golf club head 800 of the present invention which is the same as the club head 700 of FIGS. 10 and 11 except the bottom of an air channel 832 is formed below the top surface 820 and between air foil members 824.

It will be appreciated that various aerodynamic surfaces shown in this application are interchangeable without departing from the scope of the present invention. It is intended that the specification and examples are considered as exemplary only with the true scope and spirit of the invention being defined by the following claims.

I claim:

1. A wood type golf club head including a heel, toe, top surface, rear surface, and front including a ball striking face, said top surface being coincident with an upper part of said ball striking face wherein the improvement comprises:

aerodynamic means formed on said top surface creating an air flow configuration to reduce the aerodynamic drag on the club head providing greater acceleration and increased club head speed for a given force when swinging the club;

said aerodynamic means including a raised aerodynamic air foil member extending upwardly from said top surface and having a longitudinal axis in a heel-to-toe direction and located on said top surface between said front and said rear surface.

2. The golf club head of claim 1 wherein said aerodynamic member is located approximately midway between said front and said rear surfaces.

3. The golf club head of claim 1 wherein the width of said aerodynamic member is within the range of one-quarter inch to one inch.

4. The golf club head of claim 1 wherein said aerodynamic member extends upwardly at least one-eighth inch above said top surface.

5. The golf club head of claim 1 wherein said aerodynamic member is generally rectangular in shape.

6. The golf club head of claim 1 wherein said aerodynamic member is formed of a series of parallel struts.

7. The golf club head of claim 1 further including a series of aerodynamic grooves formed between said aerodynamic member and the rear surface of said club head said grooves extending perpendicular to the airfoil member and between the member and the rear surface of the club head in a front-to-rear direction.

8. The golf club head of claim 1 further including an aerodynamic channel formed perpendicular to said airfoil member and extending in a front-to-rear direction on said top surface of said club head.

9. The golf club head of claim 8 wherein said channel includes a bottom surface coincident with the top surface of the club head.

10. The golf club head of claim 8 wherein said channel includes a bottom surface located below said top surface of said club head.

11. The golf club head of claim 1 wherein said airfoil member includes a series of angular strut members positioned on said top surface.

* * * * *